US006375534B1

(12) United States Patent
Burns

(10) Patent No.: US 6,375,534 B1
(45) Date of Patent: Apr. 23, 2002

(54) BALLOON HOLDER

(76) Inventor: Judy K. Burns, 7215 Watsons Parish Dr., O'Fallon, MO (US) 63366

( * ) Notice: Subject to any disclaimer, the term of this patent is extended or adjusted under 35 U.S.C. 154(b) by 0 days.

(21) Appl. No.: 09/733,214

(22) Filed: Dec. 8, 2000

(51) Int. Cl.[7] ..... A63H 3/06

(52) U.S. Cl. ..... 446/220; 446/222; 40/214; 40/212

(58) Field of Search ..... 446/220, 222, 446/223; 40/214, 212

(56) References Cited

U.S. PATENT DOCUMENTS

| | | | | | |
|---|---|---|---|---|---|
| 2,664,667 | A | | 1/1954 | Burroughs | 446/222 |
| 2,840,948 | A | | 7/1958 | Stickley | 446/223 |
| 3,267,604 | A | | 8/1966 | Goldsmith | 446/222 |
| 4,589,854 | A | | 5/1986 | Smith | 446/223 |
| 4,661,081 | A | | 4/1987 | Basseches | 446/220 |
| 4,879,823 | A | | 11/1989 | Collins | 40/124.1 |
| 5,021,022 | A | | 6/1991 | Ganz | 446/220 |
| 5,295,891 | A | * | 3/1994 | Schalk | 446/222 |
| 5,395,276 | A | | 3/1995 | Valentino | 446/217 |
| D359,229 | S | | 6/1995 | Jules | D8/395 |
| 5,588,897 | A | | 12/1996 | Valentino | 446/217 |
| 5,738,560 | A | * | 4/1998 | Bears | 446/222 |
| 5,944,576 | A | | 8/1999 | Nelson et al. | 446/220 |

* cited by examiner

*Primary Examiner*—Kien T. Nguyen
*Assistant Examiner*—Urszula M. Cegielnik
(74) *Attorney, Agent, or Firm*—Grace J. Fishel

(57) ABSTRACT

A holder for novelty balloons has a conical plastic cup with a flanged open end. A tubular connector extends from a narrow closed end opposite the open end. A series of narrow longitudinal and narrow transverse slits in the cup receive the stem of a balloon and hold it in a tightly wrapped condition around the closed end of the cup. The holder prevents the stem from bulging with entrapped air or gas and maintains an associated balloon in the preferred upright position.

15 Claims, 4 Drawing Sheets

BALLOON HOLDER

BACKGROUND OF THE INVENTION

1. Field of the Invention

The present invention relates to the field of novelty items and particularly relates to novelty balloons. More particularly, the invention relates to holders for novelty balloons.

2. Brief Description of the Prior Art

It is known to use balloons as novelty and gift items. In particular, plastic balloons are popular because they stay inflated for long periods of time. These balloons are typically made of thin plastic sheets which are printed with colors and indicia and are welded and die cut to form hollow bodies. The hollow bodies are formed with an extending tube, called a stem, which is used to inflate the balloons with a gas, such as air or helium.

In use, the balloons may be combined with other gifts, for example, with flowers, candy or the like to form an attractive decorative arrangement. When used in such combinations, the balloons are often attached to a stalk, such as a plastic rod, tube or straw, to allow the balloon to fit into the arrangement. The balloon is attached to the stalk by a conical or funnel shaped cup which has a receiver for the stalk. A conventional cup also has holes and slots through its wall which cooperate with the balloon stem for attaching the cup to the balloon.

With a conventional cup, the inflated balloon is mounted to the cup by threading the balloon stem into the cup and out through one of the holes in the cup wall. The balloon stem is then wrapped around the base of the cup and secured by passing the stem over itself and into a slot or slots in the cup wall. With a conventional cup this attachment may permit the balloon stem to slip in the funnel shaped cup and the attachment may not be reliable. In addition, the gas in the balloon stem may bulge against the base of the balloon, causing it to tilt in the funnel shaped cup, which is aesthetically undesirable.

The attachment of a balloon to a conventional cup takes time to achieve. This is significant, since the workers who prepare the balloons and the arrangements of balloons are often paid on a piece work basis. Any savings in time of preparing a balloon, even though small, has a substantial impact on the overall earnings of the worker and improves the economies of the employer.

The following U.S. Patents are incorporated by reference herein: D 359,229, 2,664,667, 2,840,948, 3,267,604, 4,589,854, 4,661,081, 4,879,823, 5,021,022, 5,395,276, 5,588,897 and 5,944,576.

BRIEF SUMMARY OF THE INVENTION

In view of the above, it is an object of the present invention to provide an attaching cup for novelty balloons that can be rapidly attached to a balloon and that can firmly hold a balloon to the attaching cup. It is another object to provide an attaching cup for novelty balloons that can hold a balloon to the cup without tilting the balloon. It is also an object to provide an attaching cup for novelty balloons that does not require threading the end of the balloon stem of a balloon through a hole in the cup wall. An additional object is to provide an attaching cup for novelty balloons that has a narrow slit for receiving the balloon stem of a balloon and which has a rectangular transverse relieved portion at the inner extremity of the slit for holding the balloon stem. Other objects and features of the invention will be in part apparent and in part pointed out hereinafter.

In accordance with the invention, a funnel-shaped balloon cup provides a secure attachment between the balloon and the cup by using an elongated t-shaped slit or slits in the wall of the cup. An edge of the balloon stem is slipped into a leg of the slit with a downward motion, eliminating the time required to thread the stem of the balloon through a hole in the cup wall. The leg of the slit is open at the edge of the cup and shaped to guide the balloon stem into the slit, but is narrow near the inner portion to firmly hold the balloon stem.

At the inner extremity of the slit a narrow rectangular transverse relieved portion extends across the slit at a right angle. The relieved portion forms a crossarm of the t-shaped slit and permits the balloon stem to be tightly wrapped around the cup exterior and into the interior of the cup without a bulge caused by air trapped in the balloon stem. As a result, the balloon remains in a pleasing vertical relationship to the cup.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which one of various possible embodiments of the invention is illustrated, corresponding reference characters refer to corresponding parts throughout the several views of the drawings in which.

The balloon stem shown in FIGS. 4A–4F is exaggerated in size for purposes of illustration.

DETAILED DESCRIPTION OF THE INVENTION

Figure 1:
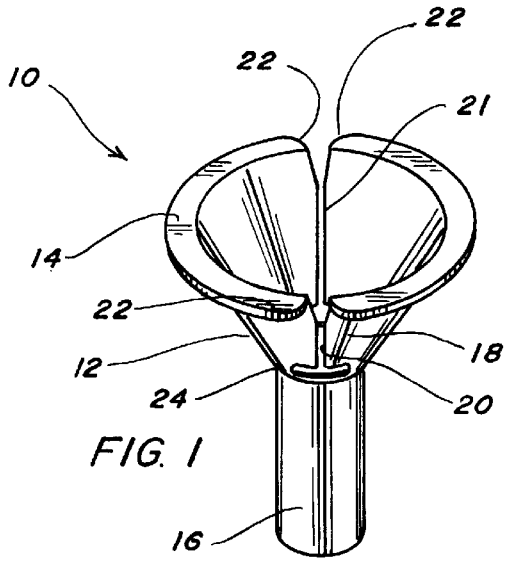
FIG. 1 is a perspective view of a balloon holder of the invention.
Figure 2:
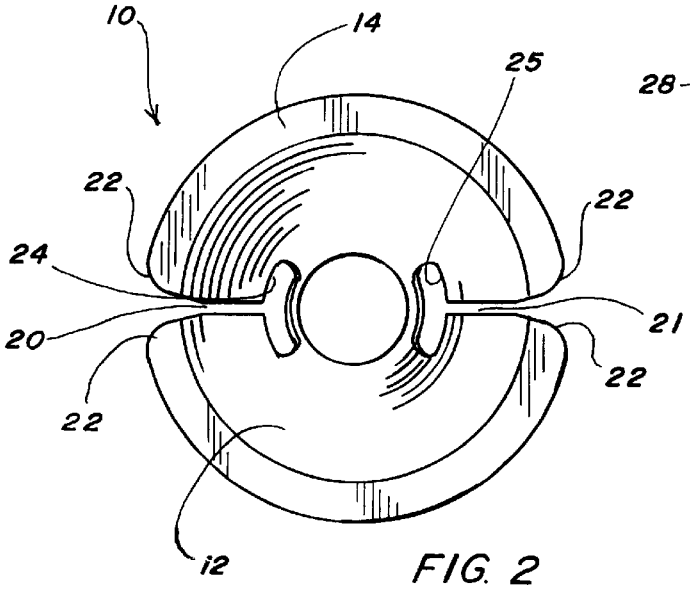
FIG. 2 is a top plan view of the balloon holder shown in FIG. 1.

Referring to the drawings more particularly by reference character, reference numeral 10 refers to an attaching cup for novelty balloons. Attaching cup 10 may be made of conventional plastic material and has a generally conical body 12. As shown in FIG. 1, an upper edge of attaching cup 10 has a flange 14, as shown. A lower portion of attaching cup 10 terminates in a depending tube 16. Tube 16 may receive a supporting stalk such as a rod, straw, or the like, not shown.

A wall 18 of attaching cup 10 has two narrow slits 20, 21 extending through flange 14 and terminating adjacent to tube 16, as shown. At the entrance to slits 20, 21, in flange 14, slits 20, 21 have open rounded guide portions 22 which can guide the stem of a balloon into slits 20, 21, as described herein.

At the inner terminal portions of slits 20, 21 are two generally rectangular transverse relieved portions 24, 25. Relieved portions 24, 25 generally extend at right angles to slits 20, 21, as shown. Also as shown, slits 20, 21 generally bisect relieved portions 24, 25. Relieved portions 24, 25 are narrow, to hold the stem of a balloon without permitting it to bulge with entrapped air or gas.

Figure 3:
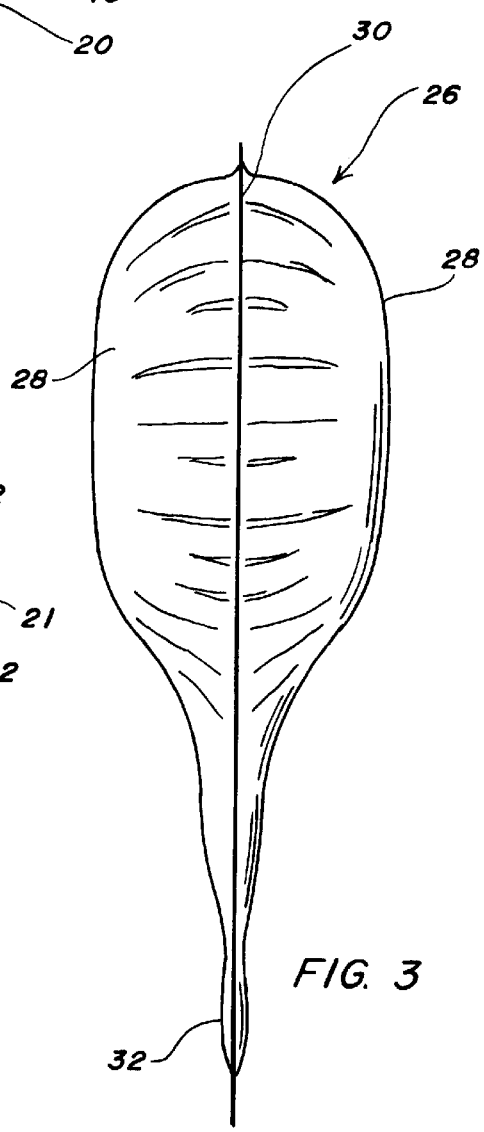
FIG. 3 is a side view of a plastic balloon of the type which may be held by the balloon holder of the invention.

FIG. 3 shows a conventional plastic balloon 26. A balloon 26 is formed of two die cut sheets 28 which are joined at a weld 30. The lower portion of balloon 26 has a stem 32 through which it is filled with gas. Inflated balloon 26 may be joined to the attaching cup 10 as shown in FIGS. 4A through 4F and as described herein. As shown in FIGS. 4A through 4F, attaching cup 10 of the invention holds stem 32 of balloon 26 substantially flat and does not permit it to entrap air or gas and bulge against the balloon 26. Balloon 26 is thus held in a vertical or untilted relationship to attaching cup 10, unlike a conventional balloon cup.

Figure 4A:
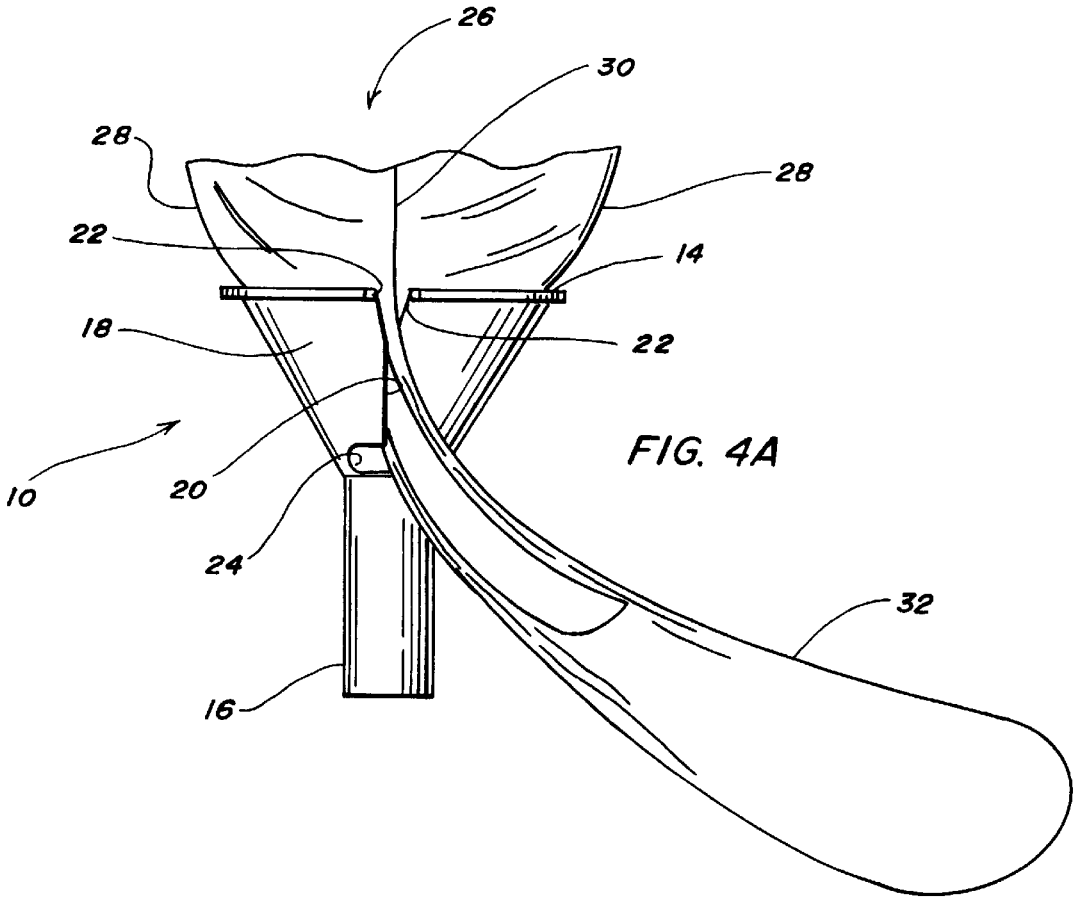
FIG. 4A is a balloon holder of the invention showing the initial step in the method of attachment.
Figure 4B:
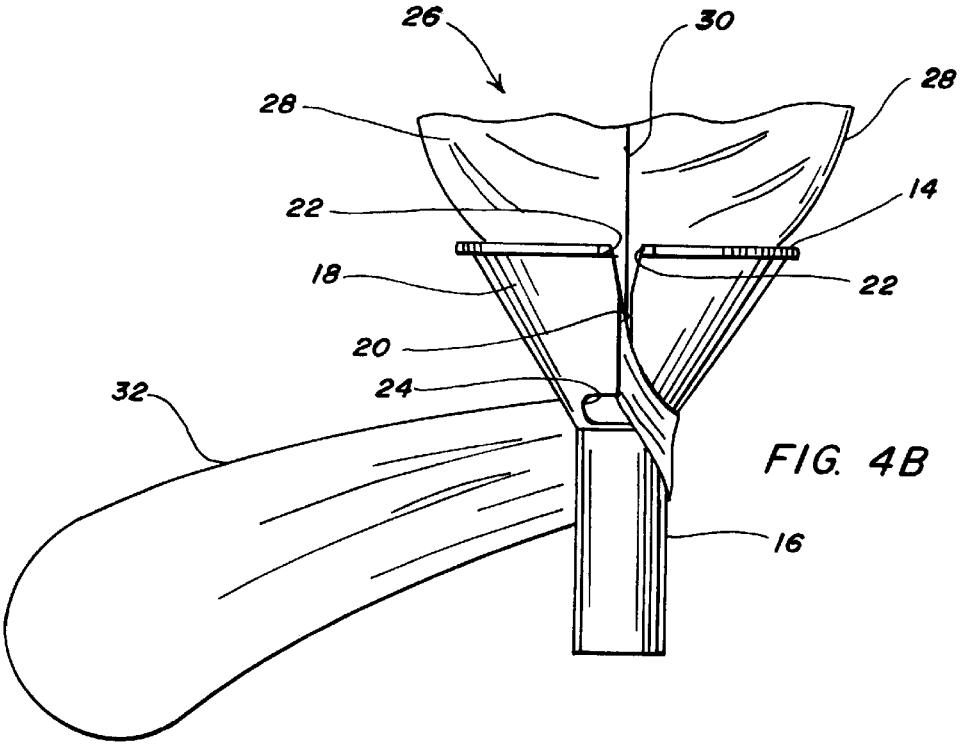
FIG. 4B shows the second step in the method of attachment.
Figure 4C:
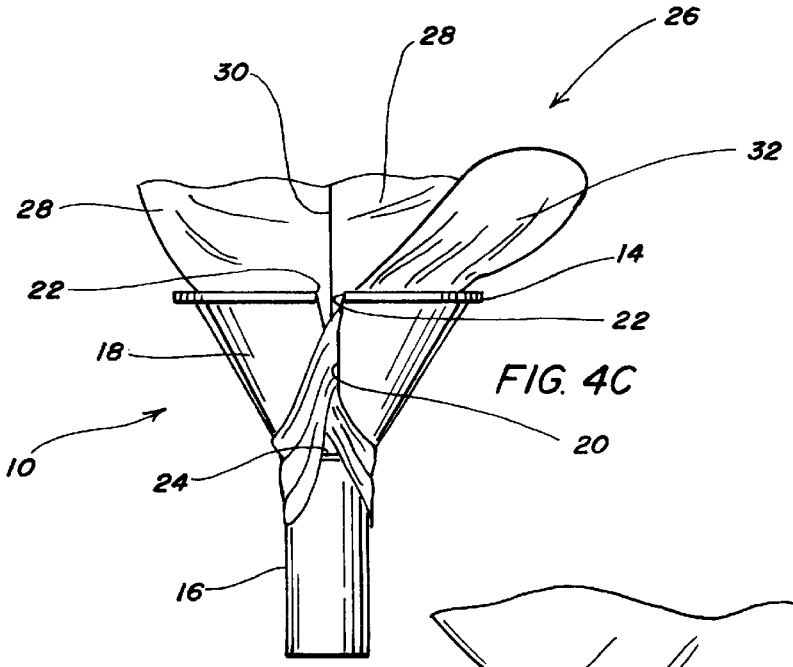
FIG. 4C shows the third step in the method of attachment.
Figure 4D:
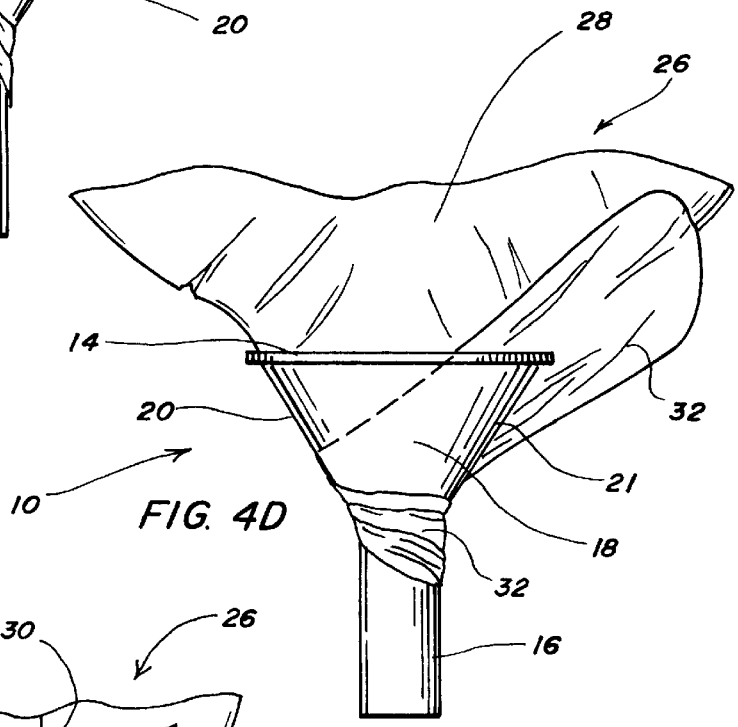
FIG. 4D shows the fourth step in the method of attachment.
Figure 4E:
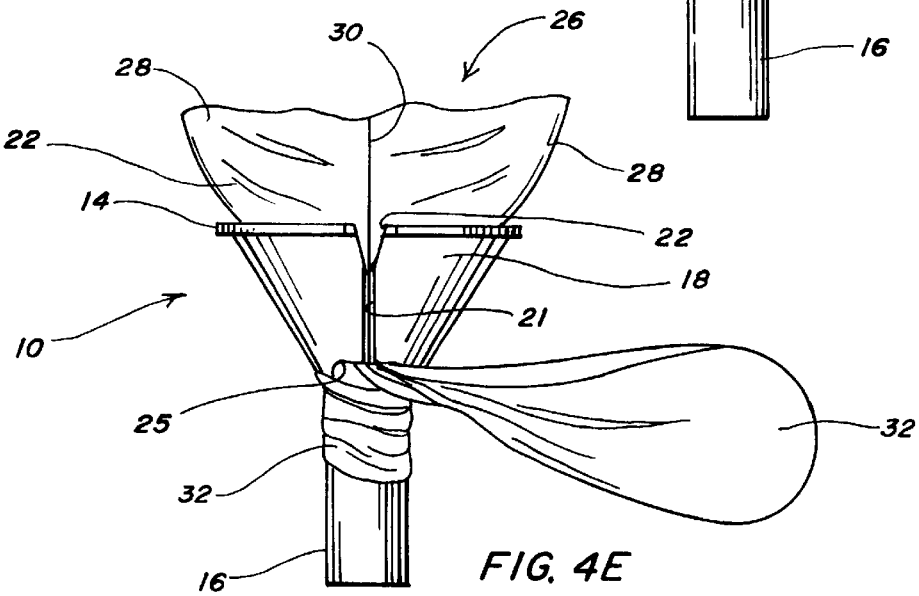
FIG. 4E shows the fifth step in the method of attachment.
Figure 4F:
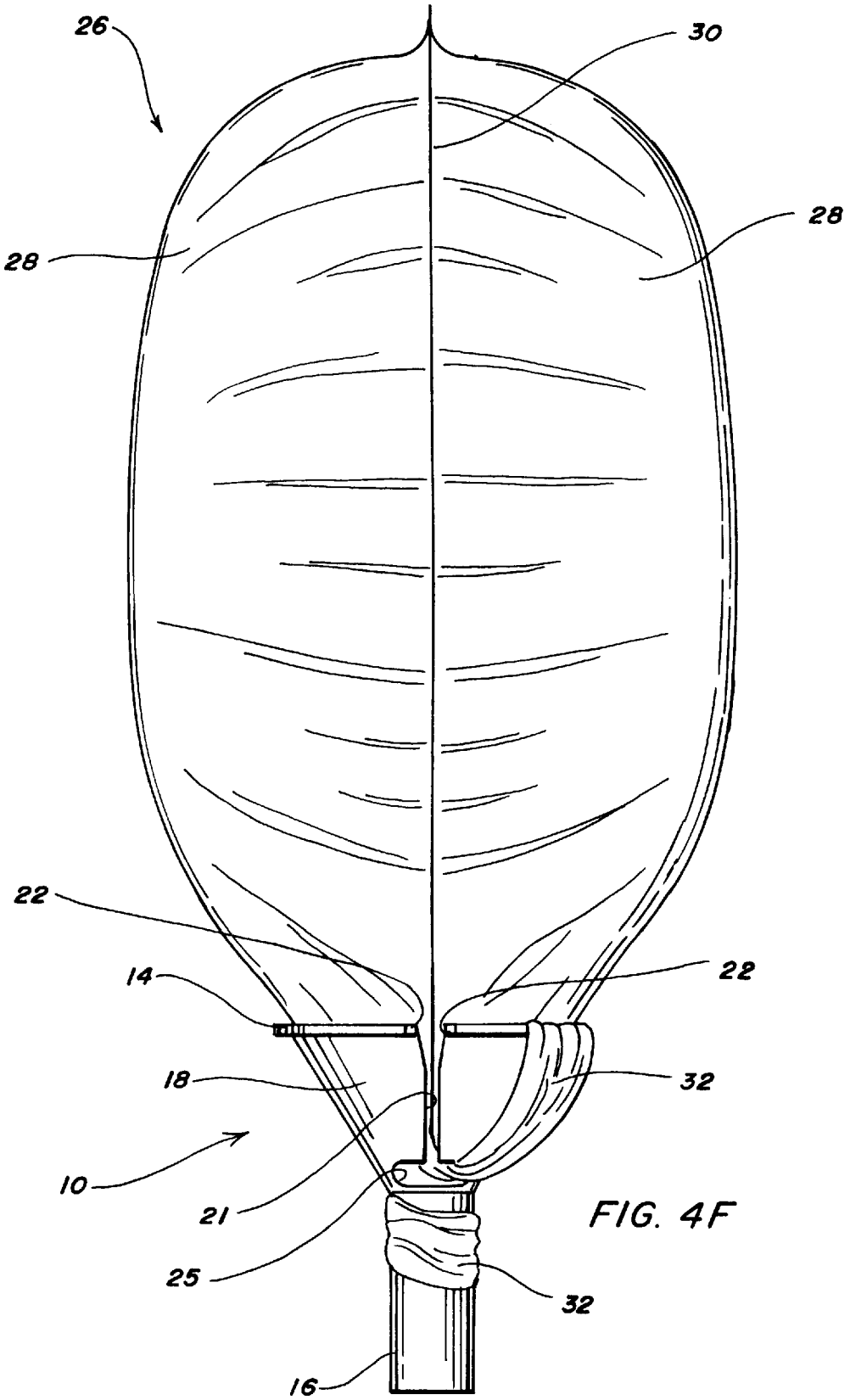
FIG. 4F shows the completed attachment of the balloon to the balloon holder of the invention.

Referring to FIGS. 4A through 4F, the method of joining balloon 26 to the attaching cup 10 is shown. After balloon 26 has been inflated, balloon 26 is placed over attaching cup 10. Stem 32 of balloon 26 is then introduced through the guides 22 in flange 14 and drawn downwardly into slit 20, as shown in FIG. 4A. Stem 32 is then wrapped tightly around wall 18 of attaching cup 10, and stem 16, as shown in FIG. 4B. As shown in FIG. 4C, stem 32 is wrapped 360 degrees around attaching cup 10. The stem 32 is then drawn back into slit 20, as tension is maintained on stem 32 to hold stem 32 flat against attaching cup 10 and to exclude air or gas from stem 32. Stem 32 is then passed around the base of balloon 26 between balloon 26 and wall 18 of attaching cup 10. As shown in FIG. 4D, stem 32 is then passed out through slit 21. Next, stem 32 is drawn sharply down to trap stem 32 in transverse relieved portion 24, not shown, and in transverse relieved portion 25, as shown in FIG. 4E. The loose end of stem 32 may then be tucked over flange 14 of attaching cup 10. The result as shown in FIG. 4F is a secure gas tight attachment of balloon 26 to attaching cup 10 that maintains balloon 26 in an aesthetically pleasing relationship to attaching cup 10.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. An attaching device for closing a stem of a balloon comprising a cup having an open end for receiving a portion of a balloon, the cup having an enclosing wall, the wall extending from the open end of the cup, the wall having an area of reduced size at a location spaced from the open end of the cup, the wall having a narrow first longitudinal slit therein, the first longitudinal slit extending from the open end of the cup to adjacent the area of reduced size, the wall having a narrow first transverse slit therein, the first transverse slit extending transverse to the first longitudinal slit and communicating therewith, the wall having a narrow second longitudinal slit therein, the second longitudinal slit extending from the open end of the cup to adjacent the area of reduced size, the second longitudinal slit being spaced from the first longitudinal slit, the wall having a narrow second transverse slit therein, the second transverse slit extending transverse to the second longitudinal slit and communicating therewith, whereby a balloon may be received in the cup with the stem of the balloon wrapped tightly around the area of reduced size and with the stem of the balloon fixed in the longitudinal and transverse slits without substantial bulging of the stem.

2. The device of claim 1 wherein the cup is conical in shape.

3. The device of claim 1 wherein the device has a flange surrounding the open end of the cup.

4. The device of claim 3 wherein the longitudinal slits extend through the flange.

5. The device of claim 4 wherein the longitudinal slits have relieved guide portions through the flange.

6. The device of claim 1 wherein the cup has a depending tube at the area of reduced size.

7. The device of claim 1 wherein the transverse slits extend across the longitudinal slits.

8. The device of claim 7 wherein the transverse slits are bisected by the longitudinal slits.

9. An attaching device for closing the stem of a balloon comprising a cup having an open end, the cup having a conical shape extending from the open end to an area of reduced diameter, the device having a connector extending from the area of reduced diameter, the device having a narrow first longitudinal slit extending from the open end to adjacent the area of reduced diameter and having a narrow first transverse slit communicating with the first transverse slit, the device having a narrow second longitudinal slit spaced from the first longitudinal slit, the second longitudinal slit extending from the open end to adjacent the area of reduced diameter, the device having a narrow second transverse slit communicating with the second longitudinal slit, whereby a balloon may be received in the cup with the stem of the balloon wrapped tightly around the area of reduced size and with the stem of the balloon fixed in the longitudinal and transverse slits without substantial bulging of the stem.

10. The device of claim 9 wherein the transverse slits are substantially rectangular and extend across the longitudinal slits.

11. The device of claim 10 wherein the longitudinal slits bisect the transverse slits.

12. The device of claim 9 wherein the cup has a flange at the open end.

13. The device of claim 12 wherein the longitudinal slits extend through the flange and have relieved guide portions at the flange.

14. The device of claim 9 wherein the connector is a tube extending from the cup at a location adjacent to the area of reduced diameter.

15. An attaching device for closing the stem of a balloon comprising a conical cup, the cup having an open end and a closed end, the closed end being of reduced diameter, the open end having a surrounding flange, the closed end having a tubular connector extending therefrom, the cup having a narrow first longitudinal slit extending from the open end of the cup to adjacent the area of reduced diameter, the cup having a narrow first transverse slit, the first transverse slit communicating with the first longitudinal slit and being bisected thereby, the cup having a narrow second longitudinal slit extending from the open end of the cup to adjacent the area of reduced diameter, the cup having a narrow second transverse slit, the second transverse slit communicating with the second longitudinal slit and being bisected thereby, the longitudinal slits extending through the flange and having means for guiding the stem of a balloon through the flange and into the longitudinal slits, the longitudinal and transverse slits receiving the stem of a balloon and holding the stem of a balloon in a tightly wrapped condition around the area of reduced diameter without bulges from entrapped air, whereby a balloon may be held in a pleasing upright position.

* * * * *